US008695967B2

(12) United States Patent
Fujita

(10) Patent No.: US 8,695,967 B2
(45) Date of Patent: Apr. 15, 2014

(54) SHEET FEEDER AND IMAGE FORMING APPARATUS INCLUDING SAME

(71) Applicant: Akihiro Fujita, Kanagawa (JP)

(72) Inventor: Akihiro Fujita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/650,292

(22) Filed: Oct. 12, 2012

(65) Prior Publication Data

US 2013/0113157 A1 May 9, 2013

(30) Foreign Application Priority Data

Nov. 7, 2011 (JP) ..... 2011-243950
May 24, 2012 (JP) ..... 2012-118316

(51) Int. Cl.
*B65H 1/08* (2006.01)

(52) U.S. Cl.
USPC ..... 271/147; 271/126; 271/160; 271/127; 271/157

(58) Field of Classification Search
USPC ..... 271/147, 160, 157, 152–156, 126, 127
See application file for complete search history.

(56) References Cited

U.S. PATENT DOCUMENTS

| | | | | |
|---|---|---|---|---|
| 2007/0182088 | A1* | 8/2007 | Tomura et al. | 271/157 |
| 2011/0024978 | A1* | 2/2011 | Nishikata et al. | 271/264 |
| 2011/0140341 | A1* | 6/2011 | Nishikata et al. | 271/3.09 |
| 2011/0140347 | A1* | 6/2011 | Nishitani et al. | 271/157 |

FOREIGN PATENT DOCUMENTS

| | | |
|---|---|---|
| JP | 2-193830 | 7/1990 |
| JP | 3-195638 | 8/1991 |
| JP | 6-056283 | 3/1994 |
| JP | 11-079420 | 3/1999 |
| JP | 2003-246468 | 9/2003 |
| JP | 2011-131960 | 7/2011 |

* cited by examiner

*Primary Examiner* — Luis A Gonzalez
(74) *Attorney, Agent, or Firm* — Harness, Dickey & Pierce, P.L.C.

(57) ABSTRACT

A sheet feeder mountable to a body of an apparatus includes a bottom plate on which the sheets are placed and a bottom plate lift unit including a bottom plate pusher disposed beneath the bottom plate, a rack member to rotate the bottom plate pusher vertically by moving horizontally, a pinion gear to move the rack member horizontally, a biasing member to pull the bottom plate pusher toward the rack member, attached therebetween, and a position detector to detect positions of the rack member and the pinion gear. The pinion gear is coupled using projection-and-recess engagement to a rotation transmission device provided to the body, and a quantity of tooth Z1 of the pinion gear by which the rack member is moved by the rotation transmission device, a total tooth number Z2 of the pinion gear, and a coupling division number S of the rotation transmission device satisfy Z1=Z2·(1/S)·N.

6 Claims, 8 Drawing Sheets

SHEET FEEDER AND IMAGE FORMING APPARATUS INCLUDING SAME

CROSS-REFERENCE TO RELATED APPLICATIONS

This patent application is based on and claims priority pursuant to 35 U.S.C. §119 to Japanese Patent Application Nos. 2011-243950 filed on Nov. 7, 2011, and 2012-118316 filed on May 24, 2012 in the Japan Patent Office, the entire disclosure of each of which is hereby incorporated by reference herein.

FIELD OF THE INVENTION

The present invention generally relates to a sheet feeder to feed sheets to an image forming apparatus, and an image forming apparatus including same.

BACKGROUND OF THE INVENTION

Sheet feeders for image forming apparatuses typically include a separator to feed one by one sheets of recording media stacked on a sheet tray or sheet cassette, and a feed roller or a pickup roller disposed above the sheets stacked on the sheet tray. The separator can prevent multifeed.

Prior to sheet feeding, the sheets are pressed against the pickup roller, which involves elevation of a bottom plate of the sheet tray. Spring compression methods and motor control methods can be used to elevate the bottom plate.

In spring compression methods, typically a spring is elongated, or a compressed spring is released, by a force to insert the sheet tray into a body of the apparatus, thereby lifting the bottom plate. Although this can be achieved by a simple mechanism at a low cost, a stronger force is required to insert or draw out the sheet tray from the body, thus degrading operability. This also imposes a limitation on the quantity of sheets contained in the sheet tray.

In motor control methods, there is a difficulty in connection between a lift unit to elevate the bottom plate and a motor drive unit for driving the lift unit.

Couplings are widely used for connection structures, and various approaches have been tried to improve coupling connection structures. For example, for elevating the bottom plate of the sheet tray that can be drawn out from the body of the image forming apparatus, JP-H11-079420-A proposes a drive unit that includes a drive shaft projecting from a surface of the sheet tray on the side of the body, a spring pin fitted in the end of the drive shaft in a direction perpendicular to an axial direction, and a coupling driven by a motor. The drive shaft elevates the bottom plate by rotating unidirectionally. An engagement groove in which the spring pin fits is formed in the body, and the coupling is pushed to the sheet tray movably in the axial direction. When the sheet tray is inserted into the image forming apparatus, rotation of the coupling is transmitted to the drive shaft, thereby lifting the bottom plate.

In coupling connection structures, if phases of the elements connected together are shifted from each other, generally a strong force is necessary to insert the sheet tray into the apparatus body. Moreover, those elements cannot be connected together.

Additionally, JP-H06-056283-A proposes the following unit for elevating the bottom plate of the sheet tray. A push-up lever is disposed beneath the bottom plate and fixed to a rotary shaft, and a pressure arm engages and is disengaged from the rotary shaft via the push-up lever and a drive connecting and disconnecting means. This unit further includes a rotating member constructed of a missing-teeth gear and a cam united to the missing-teeth gear, a drive gear that engages the missing-teeth gear to drive the rotating member, a stopper that engages an engagement portion of the cam, a pressure spring stretched between the pressure arm and the rotating member, and a release member to release the stopper from the cam by insertion operation of the sheet tray. When missing-teeth gears are used, a retainer to retain the missing-teeth gear at a predetermined position, a position detector, and the like are necessary.

Additionally, in JP-2003-246468-A, a sector gear is provided to a rotary shaft of a push-up lever to lift the bottom plate. When the sheet tray is mounted in the apparatus and the bottom plate is rotated, the sector gear rotates and is connected to a lift unit, thus pushing the sheet tray in a direction in which the sheet tray is inserted. Then, a member provided to the sheet tray for lifting the bottom plate is fitted in a coupling provided to the body of the apparatus.

BRIEF SUMMARY OF THE INVENTION

In view of the foregoing, one embodiment of the present invention provides a sheet feeder mountable to a body of an apparatus to feed sheets thereto. The sheet feeder includes a bottom plate on which the sheets are placed and a bottom plate lift unit. The bottom plate lift unit includes a bottom plate pusher disposed beneath the bottom plate to push up the bottom plate, a rack member to rotate the bottom plate pusher vertically by moving horizontally, a pinion gear to cause the rack member to move horizontally, a biasing member attached between the bottom plate pusher and the rack member to pull the bottom plate pusher toward the rack member, and a position detector to detect positions of the rack member and the pinion gear. The pinion gear is coupled using projection-and-recess engagement to a rotation transmission device provided to the body to transmit a drive force for rotating the bottom plate pusher. In this sheet feeder, a quantity of tooth Z1 of the pinion gear by which the rack member is moved by the rotation transmission device, a number of tooth Z2 in total of the pinion gear, and a coupling division number S of the rotation transmission device satisfy $Z1=Z2\cdot(1/S)\cdot N$.

Another embodiment provides a sheet feeder mountable to a body of an apparatus to feed sheets thereto and including the bottom plate and the bottom plate lift unit described above. In this sheet feeder, the pinion gear is coupled using projection-and-recess engagement to the rotation transmission device similarly, and a quantity of tooth of the rack member, a quantity of tooth of the pinion gear, a reference phase position for coupling portions of the pinion gear and the rotation transmission device, and a rotation number of the rotation transmission device connected to the pinion gear are set to secure conformity in phase among the following three of: the coupling portion of the pinion gear when the pinion gear is disconnected from the rotation transmission device and the bottom plate is at a lowest position; the couple portion of the rotation transmission device being disconnected from the pinion gear when driving is stopped; and the coupling portion of the rotation transmission device being connected to the pinion gear when driving is stopped after the bottom plate is lifted to a predetermined elevation position.

Yet another embodiment provides an image forming apparatus that includes an image forming unit and either of the above-described sheet feeders.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
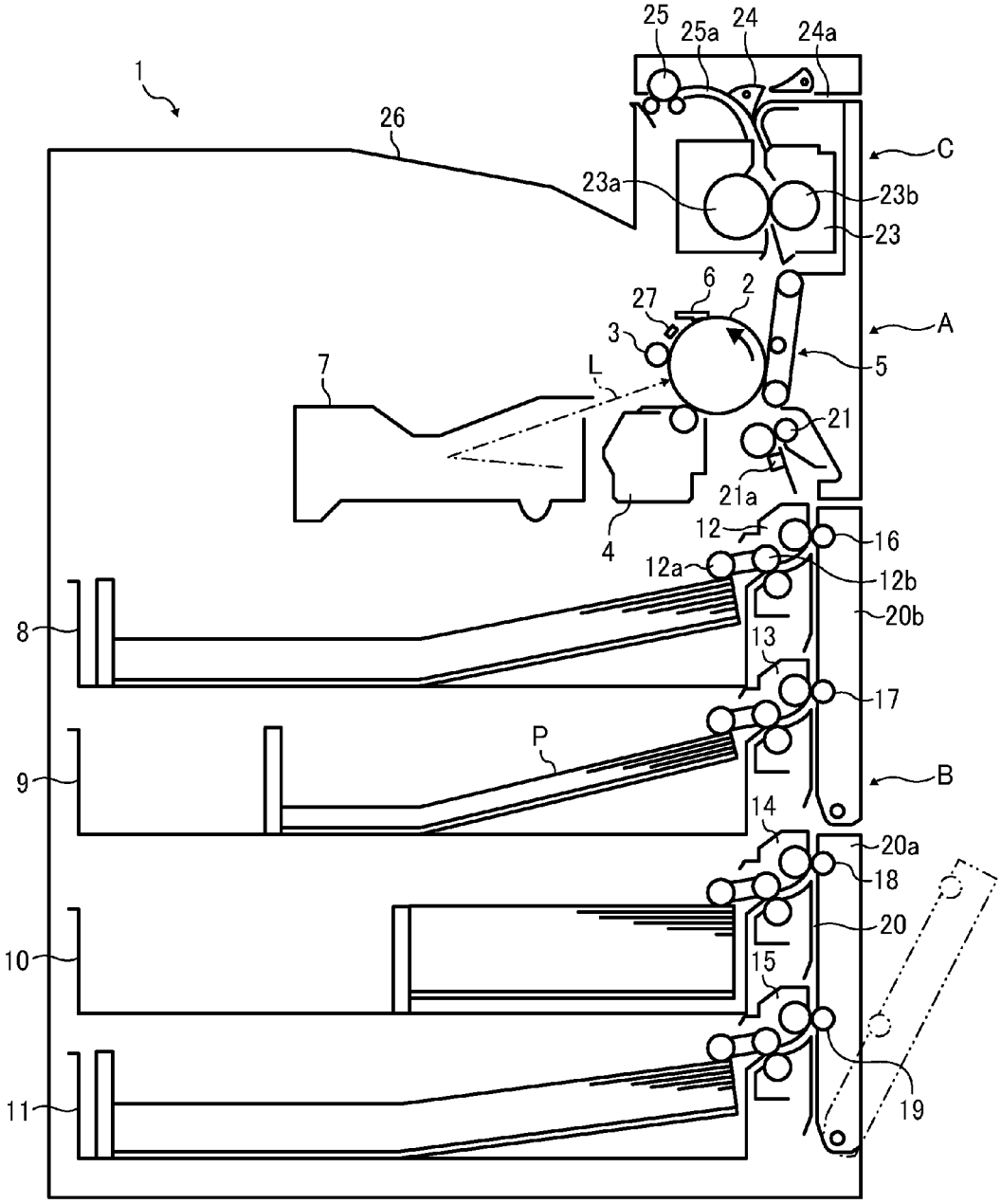
FIG. 1 is a schematic view of an image forming apparatus including a sheet feeder according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 2:
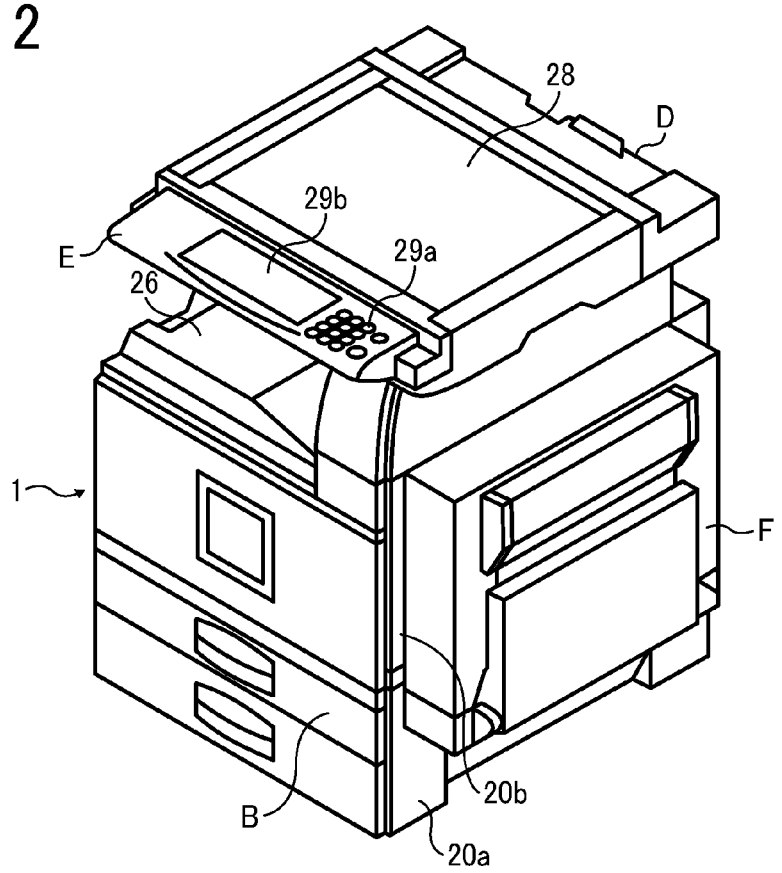
FIG. 2 is a perspective view illustrating an exterior of the image forming apparatus shown in FIG. 1.
Figure 3:
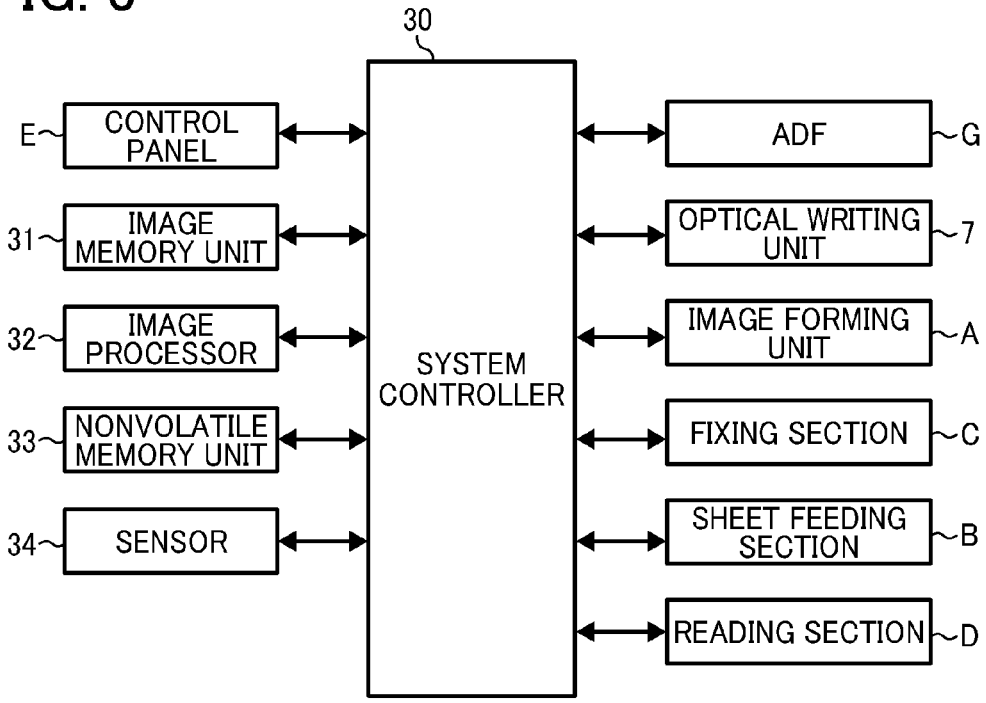
FIG. 3 is a block diagram illustrating a control configuration of an image forming apparatus according to an embodiment.

Referring now to the drawings, wherein like reference numerals designate identical or corresponding parts throughout the several views thereof, and particularly to FIGS. 1 through 3, an image forming apparatus including a sheet feeder according to an embodiment of the present invention is described.

It is to be noted that an image forming apparatus 1 shown in the drawings is a so-called digital multifunction machine. However, embodiments of the present invention are not limited thereto and can include various types of image forming apparatuses, such as digital copiers, analogue copiers, printers, and facsimile machines, that form images on sheets of recording media.

Referring to FIGS. 1 and 2, the image forming apparatus 1 includes an image forming unit A, a sheet feeding section B, a fixing section C, a reading section (i.e., scanner) D, and a control panel E.

The image forming unit A includes a photoreceptor drum 2 and components provided around an outer circumference thereof. Specifically, a charging unit 3, a development device 4, a transfer unit 5, a cleaning blade 6, and a discharge lamp 27 are provided around the photoreceptor drum 2 in that order in the direction in which the photoreceptor drum 2 rotates, which is counterclockwise in FIG. 1. Optical writing is executed on the surface (i.e., an exposed surface) of the photoreceptor drum 2 with a laser beam L between the charging unit 3 and the development device 4. The image forming apparatus 1 further includes an optical writing unit 7 that includes a light source and an optical scanning system to direct the laser beam L emitted from the light source onto the surface of the photoreceptor drum 2. The optical scanning system includes a polygon mirror, an imaging lens, and the like to cause the laser beam L to scan the photoreceptor drum 2 in the axial direction or direction similar thereto, which is referred to as "main scanning direction".

The charging unit 3 electrically charges the surface of the photoreceptor drum 2 to a predetermined potential, and then the laser beam L is directed thereto, thereby forming a latent image thereon. The latent image is developed with toner by the development device 4 and transferred by the transfer unit 5, which includes a transfer belt, onto a sheet of recording media transported by the sheet feeding section B. The sheet is then transported to the fixing section C. It is to be noted that the term "sheet" used in this specification is not limited paper but can be any of recording media on which images can be formed. After image transfer, the cleaning blade 6 removes toner remaining on the surface of the photoreceptor drum 2, and the discharge lamp 27 discharges the surface of the photoreceptor drum 2. Subsequently, the photoreceptor drum 2 is rotated to the charging unit 3. In other words, charging, optical writing, image development, image transfer, cleaning, and discharging are performed on the photoreceptor drum 2 while the photoreceptor drum 2 makes one revolution. This operation is performed for each image formed on a sheet.

The sheet feeding section B includes four sheet trays 8 through 11 (the number of sheet trays is not limited thereto), feeding units 12 through 15 to draw sheets from the respective sheet trays 8 through 11, pairs of conveyance rollers 16 through 19, and a pair of registration rollers 21. Each of the feeding units 12 through 15 is provided in an upper portion at the exit of one of the sheet trays 8 through 11 in the direction in which the sheet is transported (hereinafter "sheet conveyance direction").

As shown in FIG. 1, each of the feeding units 12 through 14 includes a pickup roller 12*a* serving as a feed roller, and a separation roller 12*b* serving as a separator.

The pairs of conveyance rollers 16 through 19 are provided along a vertical conveyance channel 20 through which sheets are conveyed to the image forming unit A, and the registration rollers 21 are provided at a downstream end of the vertical conveyance channel 20. In the configuration shown in FIGS. 1 and 2, the upper two of the four sheet trays 8 are provided to a body of the image forming apparatus 1, whereas the lower two are disposed beneath the body. The sheet trays 8 through 11 can be mounted to and pulled out from the body of the image forming apparatus 1.

The vertical conveyance channel 20 is defined by side plates 20*a* and 20*b*, which are hinged to the body at a lower portion thereof and can be opened relative to the body as shown in FIG. 1. In this configuration, the side plates 20*a* and 20*b* can be opened to remove jammed sheets if a sheet jam occurs in the vertical conveyance channel 20 or at the exit of the feeding unit 12, 13, 14, or 15. As shown in FIG. 2, a duplex unit F can be provided to the side plates 20*a* and 20*b* as required. Additionally, a registration detector 21*a* is provided upstream from the registration rollers 21 in the sheet conveyance direction to detect the presence of sheets at the registration rollers 21.

The fixing section C is constructed of a fixing device 23 disposed immediately downstream from the transfer unit 5 in the sheet conveyance direction. The fixing device 23 includes a heating roller 23*a* and a pressure roller 23*b*. A branch pawl 24 is disposed downstream from the fixing device 23 in the sheet conveyance direction to switch the destination of sheets to a discharge channel 25*a* through which the sheets are discharged by discharge rollers 25 to a discharge tray 26 and a duplex conveyance channel 24*a* through which the sheets are conveyed to the duplex unit F shown in FIG. 2.

The reading section D is positioned above the discharge tray 26 as shown in FIG. 2 and includes an exposure glass 28 on which an original is placed. The exposure glass 28 is at an upper end of the reading section D. Additionally, an automatic document feeder (ADF) G (shown in FIG. 3) can be provided above the reading section D to feeds originals automatically to the exposure glass 28 for optical scanning.

As shown in FIG. 2, the control panel E is disposed above the body and on a front side of the image forming apparatus 1. The control panel E includes a group of buttons 29*a* such as a print start button and a display 29*b* to display an operation menu and various types of information. For example, the display 29*b* can be constructed of a touch panel or a group of operation buttons.

Referring to FIG. 3, a control configuration of the image forming apparatus 1 according to the present embodiment is described below.

As shown in FIG. 3, a system controller 30 is provided to the body of the image forming apparatus 1 to control the image forming unit A, the sheet feeding section B, the fixing section C, and the reading section D described above. Further, the control panel E, an image memory unit 31, an image processor 32, a nonvolatile memory unit 33, and various detectors are connected to the system controller 30. In response to users' instructions input via the control panel E, the system controller 30 controls the respective sections and units to perform operations according to the instructions. For example, the system controller 30 stores image data ready by the reading section D temporarily in the image memory unit 31, causes the image processor 32 to execute predetermined image processing or image processing requested by the user, and outputs image data to the optical writing unit 7. The system controller 30 further controls image formation by the image forming unit A, transfer of the image onto the sheet transported by the sheet feeding section B, fixing of the image fixing section C, and discharge of the sheet by the discharge rollers 25 or conveyance of the sheet to the duplex unit F. The system controller 30 can execute the above-described control operation according to programs stored in the nonvolatile memory unit 33.

Alternatively, the control programs may be downloaded to a hard disk device from a server via a network, or from recording media such as a compact disc read-only memory (CD-ROM) or secure digital (SD) cards loaded in a media drive device. Additionally, version upgrade of the control programs may be executed similarly.

Next, the sheet feeding section B is described in further detail below with reference to FIGS. 4 through 7.

Although the sheet tray according to the present embodiment corresponds to any of the sheet trays 8 through 10, reference numeral 10 is given to the sheet tray shown in FIG. 4 and that descried below. The sheet tray 10 includes a bottom plate 51 to push up sheets contained in the sheet ray 10, a front fence 52, a back fence 53, an end fence 54, and a lift unit 55 to push up the bottom plate 51. The sheets can be retained at a predetermined position by the front fence 52, the back fence 53, and the end fence 54. The bottom plate 51 is attached to the front fence 52 and the back fence 53 with support portions 51*a* (shown in FIG. 5) respectively such that the bottom plate 51 is rotatable vertically.

Figure 4:
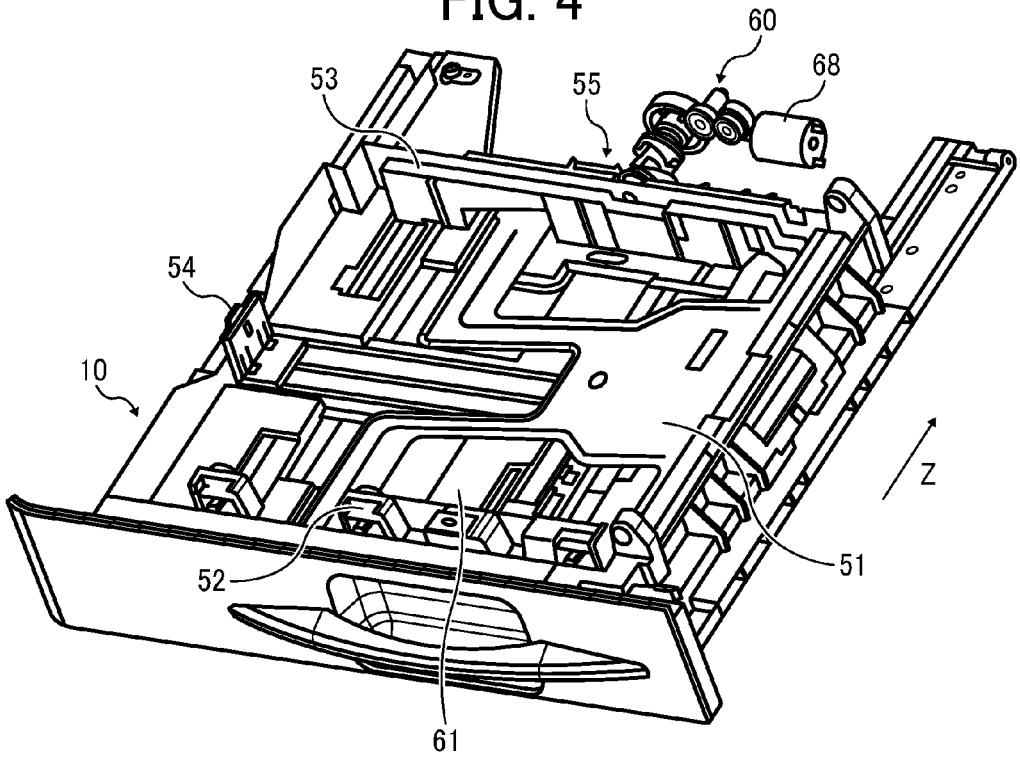
FIG. 4 is a perspective view illustrating an exterior of a sheet tray included in a sheet feeder according to an embodiment.

As shown in FIG. 4, the sheet tray 10 is provided with a drive unit 60 serving as a drive transmission unit to transmit drive force from a motor 68.

Figure 5:
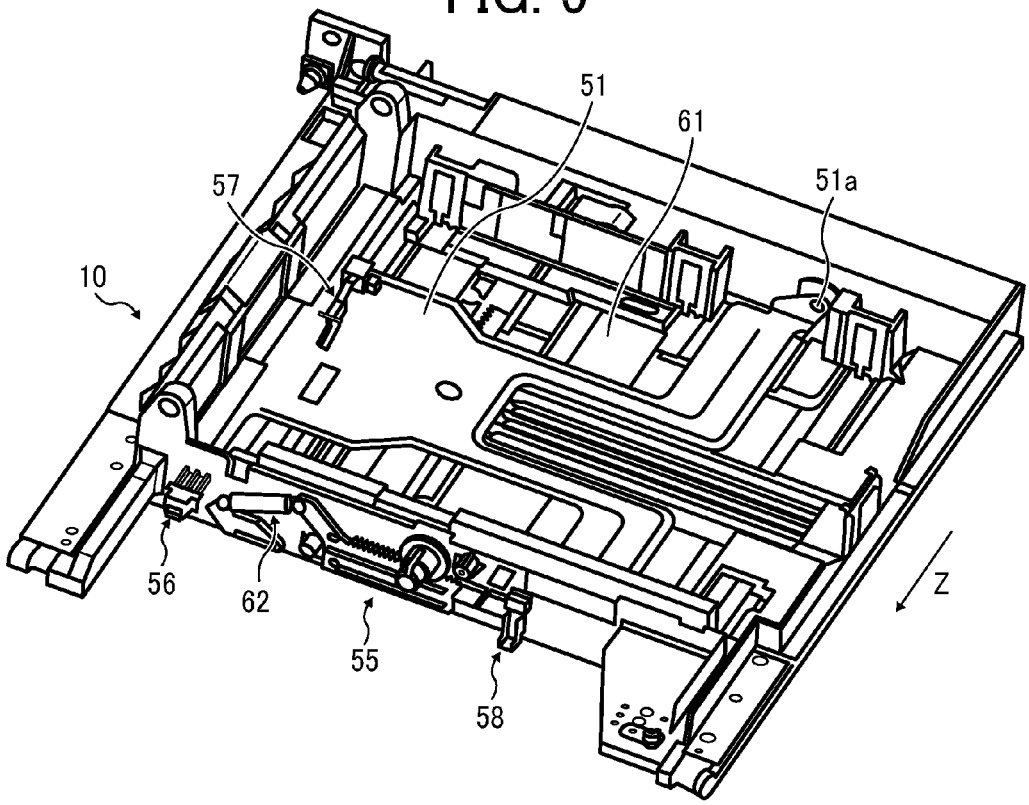
FIG. 5 is a perspective view illustrating a state in which a bottom plate of the sheet tray is at an elevated position as viewed from a distal side in FIG. 4.
Figure 6:
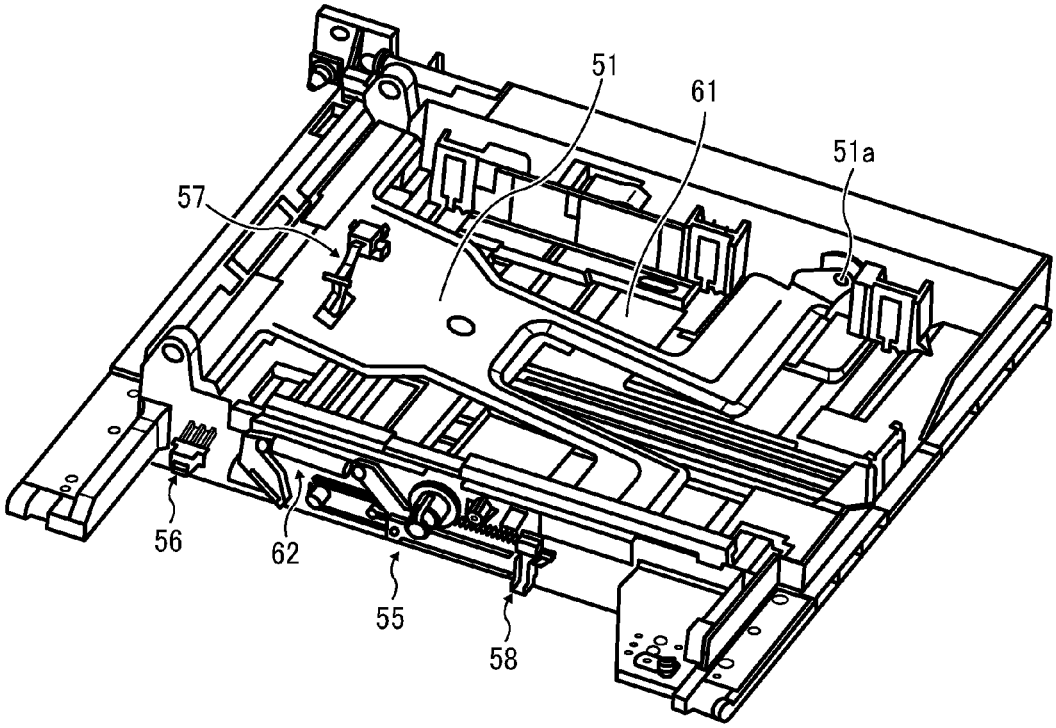
FIG. 6 is a perspective view illustrating a state in which the bottom plate of the sheet tray is at a lower position as viewed from the distal side in FIG. 4.

It is to be noted that, in FIG. 5, reference numerals 56 represents a tray detector to detect the position of the sheet tray 10, and 57 represents a sheet detector to detect the presence of sheets in the sheet tray 10. Additionally, the sheet tray 10 is provided with a position detector 58 to detect a position of a rack 63 described later.

As shown in FIG. 7, the lift unit 55 includes a bottom plate pusher 61 to push or rotate upward the bottom plate 51, the rack 63 that moves horizontally to rotate the bottom plate pusher 61 with a spring 62 serving as a biasing member, and a pinion gear 64 to move the rack 63. The spring 62 is attached to a hook 61*a* of the bottom plate pusher 61 and a hook 63*a* of the rack 63. The pinion gear 64 includes a projection 67 (i.e., a coupling portion) that engages a recess 66 (i.e., a coupling portion) formed in a coupling 65 of the drive unit 60.

The drive unit 60 includes the motor 68, a worm gear 69, a train of drive gears 70, the coupling 65 in which the recess 66 is formed, and a spring 71. For example, the motor 68 can be a direct current (DC) motor. It is to be noted that, although the number of the drive gears 70 is three in the configuration shown in FIGS. 7A and 7B, the number is not limited thereto. The recess 66 of the coupling 65 and the projection 67 of the pinion gear 64 and serve as coupling portions, and thus coupling 65 and the pinion gear 64 are coupled to each other using projection-and-recess engagement.

Operations of the lift unit 55 and the drive unit 60 are described below, referring also to FIGS. 8A and 8B.

Figure 8A:
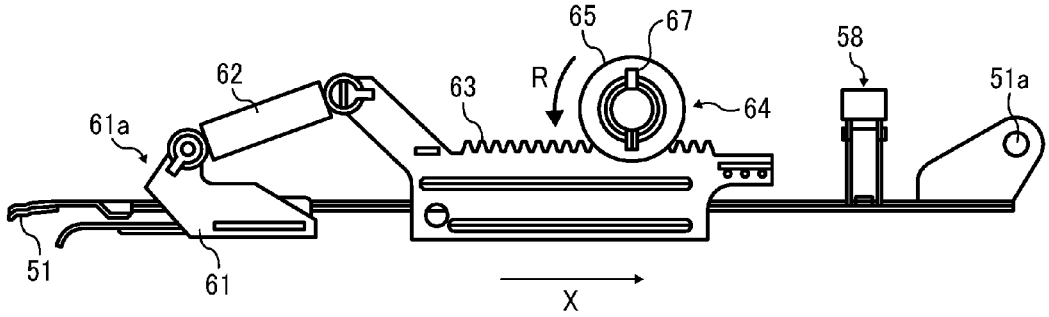
FIG. 8A is a side view of the bottom plate lift unit when the sheet tray is not mounted in an apparatus body.
Figure 8B:
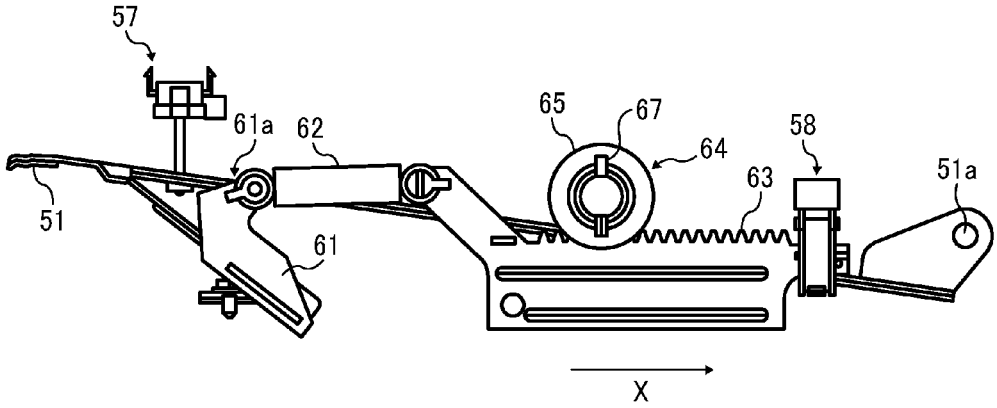
FIG. 8B is a side view of the bottom plate lift unit when the bottom plate is at the elevated position.

FIG. 8A illustrates a state in which the bottom plate 51 is at a lower position (also shown in FIG. 5). In this state, the pinion gear 64 is rotated in the direction indicated by arrow R shown in FIG. 8A (hereinafter simply "direction R") by the motor 68 of the drive unit 60, thereby moving the rack 63 in the direction indicated by arrow X (hereinafter simply "direction X"). Being pulled by the rack 63 moving in the direction X, the spring 62 rotates the bottom plate pusher 61 upward to the position shown in FIG. 8B. Accordingly, the bottom plate pusher 61 pushes the bottom plate 51 up, and the bottom plate 51 pivots upward around the support portions 51*a*. In other words, as the pinion gear 64 rotates, the bottom plate 51 and the sheets stacked thereon are lifted until the sheets are pressed against the pickup roller 12*a* provided to the body of the image forming apparatus 1. It is to be noted that the strength of force pushing up the bottom plate 51 depends on the pressing force exerted by the spring 62.

Next, the motor 68 rotates the coupling 65 of the drive unit 60 to transmit a drive force to the lift unit 55. The coupling 65 is held by the spring 71 such that the coupling 65 can move in the direction in which the sheet tray 10 is inserted into the body.

It is to be noted that, being connected to the worm gear 69, the motor 68 is configured to have a high reduction ratio, and a relatively large force is required to rotate the coupling 65 when the motor 68 is not driving. Accordingly, the coupling 65 is not rotated with rotation load of the lift unit 55, and the lift unit 55 stops in synchronization with the motor 68.

It is assumed that the weight of the bottom plate 51 of the sheet tray 10 causes the lift unit 55 to rotate down, and that the bottom plate 51 is retained in contact with a lower housing of the sheet tray 10. In this state, sheets are placed on the bottom plate 51. Then, the front fence 52, the back fence 53, and the end fence 54 are pressed against the sheets, thereby setting the sheets in position. Thus, loading of sheets is completed. It is to be noted that the projection 67 of the pinion gear 64 is provided vertically. Although positioning of the projection 67 is not necessary during assembling, a case in which the projection 67 is connected vertically is described as an example.

Elevation of the bottom plate 51 in the above-described case is described below.

The sheet tray 10 is inserted into the body of the image forming apparatus 1. The tray detector 56 provided to the body of the image forming apparatus 1 detects whether the sheet tray 10 is set. Simultaneously, the projection 67 of the pinion gear 64 of the lift unit 55 is inserted into the recess 66 of the coupling 65 of the drive unit 60, and they are connected together. At that time, if the phase of the projection 67 is shifted from that of the recess 66, the projection 67 of the pinion gear 64 pushes down the coupling 65 and stops. Since the coupling 65 is pressed by the spring 71, a predetermined amount of load is applied to the pinion gear 64. It is to be noted that the projection 67 can enter the recess 66 when the coupling 65 is rotated by the motor 68, and thus connection therebetween is completed, enabling drive transmission.

Figure 9A:
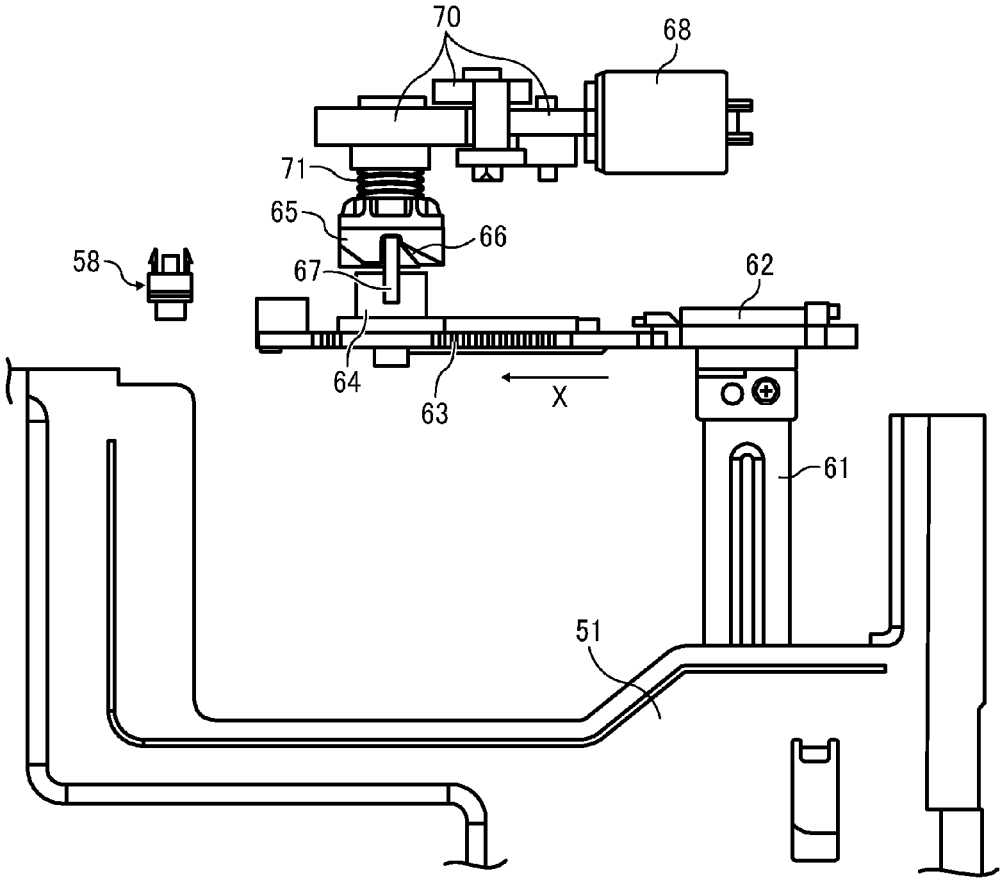
FIG. 9A illustrates a proper engagement between a projection and a recess of a coupling.
Figure 9B:
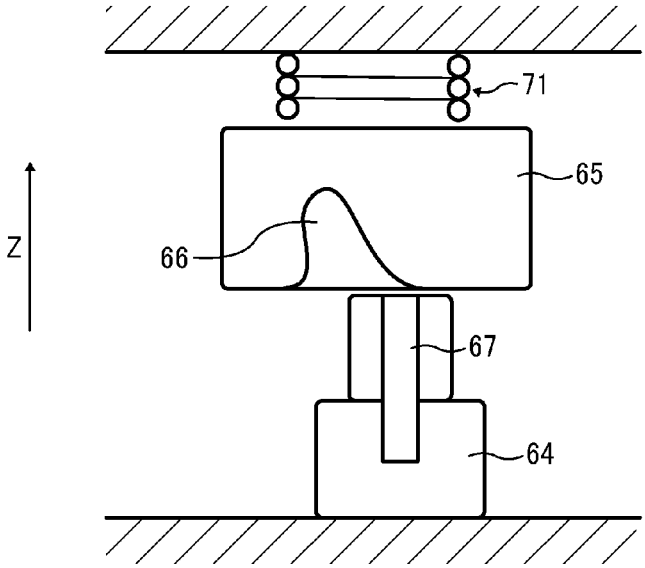
FIG. 9B illustrates a state in which the phase of the projection is shifted from that of the recess of the coupling.

FIG. 9A illustrates a state in which the projection 67 engages the recess 66 properly, and FIG. 9B illustrates a state in which the phase of the projection 67 is shifted from that of the recess 66. If the phases therebetween are shifted, the coupling 65 having the recess 66 is pushed in the direction indicated by arrow Z, and the spring 71 is deformed. Needles to say, it is not desirable because the pinion gear 64 receives a relatively strong force.

Subsequently, the motor 68 of the drive unit 60 is rotated, thereby rotating the pinion gear 64 counterclockwise in the drawings. The rack 63 connected to the pinion gear 64 moves in the direction X shown in FIGS. 8A to 9A, turning on the position detector 58, and stops.

In the present embodiment, a quantity of tooth representing the amount by which the rack 63 is moved (hereinafter "tooth number Z1" or "travel amount of the rack 63") can be expressed as $Z1=Z2\cdot(1/S)\cdot N$, wherein Z2 represents a quantity (number in total) of tooth of the pinion gear 64 (hereinafter "tooth number Z2"), S represents a division number of the coupling 65, and N represents rotation number of the coupling 65. For example, when the tooth number Z2 of the pinion gear 64 is 20, the division number S of the coupling 65 is 2, and the rotation number is 1, the tooth number Z1 (travel amount of the rack 63) is:

$$Z1=20\cdot(1/2)\cdot 1=10$$

That is, when the rack 63 is moved an amount corresponding to ten tooth and stopped, the pinion gear 64 facing the rack 63 rotates a half circle for the half of 20 tooth, that is, 10 tooth (Z2), and the projection 67 is at a vertical position similarly to the state in which the sheet tray 10 is not inserted.

Figure 7A:
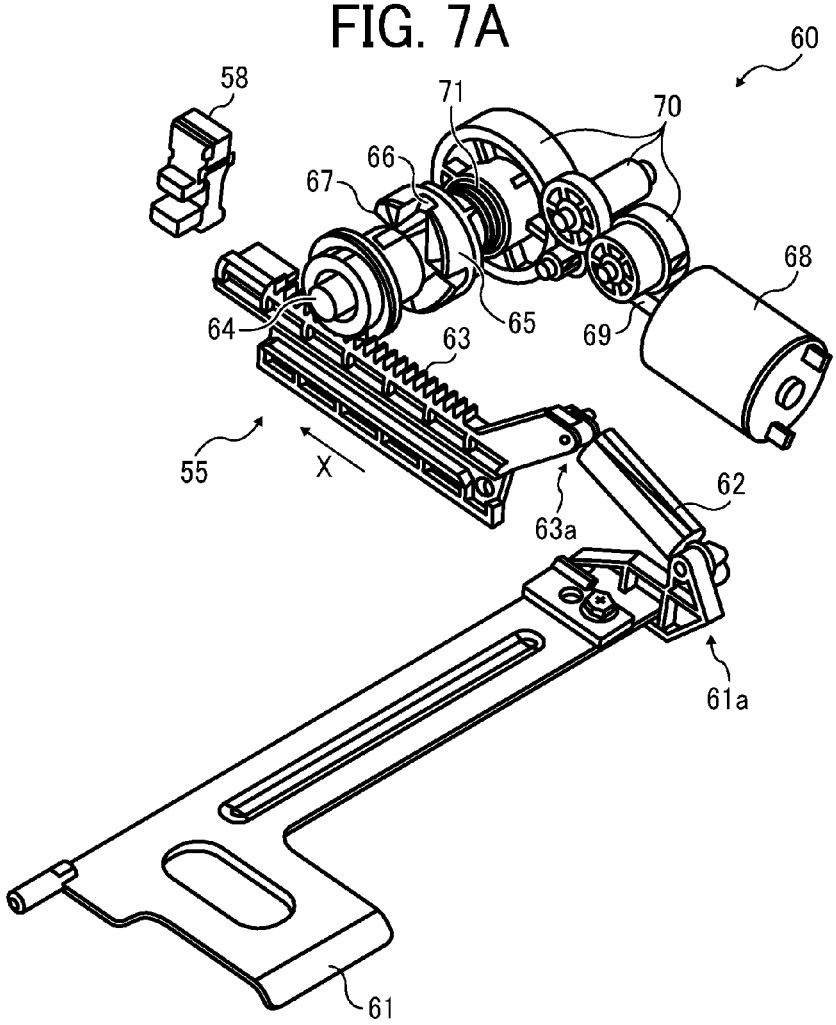
FIGS. 7A and 7B are enlarged perspective views that illustrate a bottom plate lift unit provided to the sheet tray shown in FIG. 4.
Figure 7B:
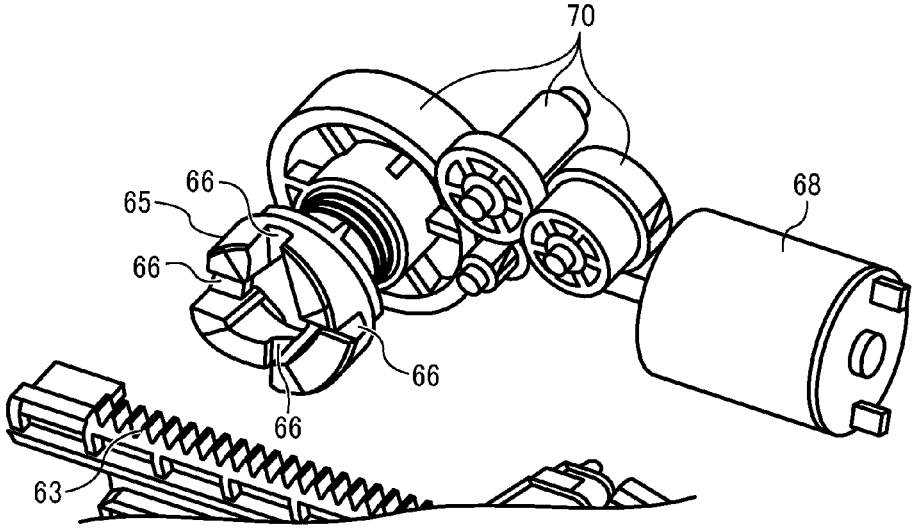

Similarly, when the tooth number Z2 of the pinion gear 64 is 20, the division number of the coupling 65 is 4 as shown in FIG. 7B, and the rotation number N is 1, the tooth number Z1 is:

$$Z1=20\cdot(1/4)\cdot 1=5$$

That is, when the rack 63 is moved an amount corresponding to five tooth and stopped, the pinion gear 64 facing the rack 63 rotates a quarter circle for five tooth (Z2=20). Although the projection 67 is at a horizontal position, the recess 66 of the coupling 65 is at a horizontal position similarly. Accordingly, engagement failure (phase shift) in coupling does not occur.

In the present embodiment, a total tooth number of the rack 63, the tooth number Z2 of the pinion gear 64, a reference phase position of the pinion gear 64 and the coupling 65, and the rotation number N of the coupling 65 are determined to secure conformity in phase among reference positions of the following three: the projection 67 of the pinion gear 64 (coupling projection on the sheet tray side) when the lift unit 55 (pinion gear 64) is not coupled to the drive unit 60 (drive transmission unit) and the bottom plate 51 is at a lowest position; the recess 66 of the coupling 65 (coupling recess) of the drive unit 60 when the lift unit 55 is not coupled to the drive unit 60 and driving is stopped; and the recess 66 of the coupling 65 (coupling recess on body side or drive unit side) in the state in which the lift unit 55 is coupled to the drive unit 60 and the drive unit 60 is stopped after the bottom plate 51 is lifted to a predetermined elevated position. It is to be noted that, alternatively, the coupling portion of the pinion gear 64 can be a recess, and that of the coupling 65 can be a projection.

Figure 10:
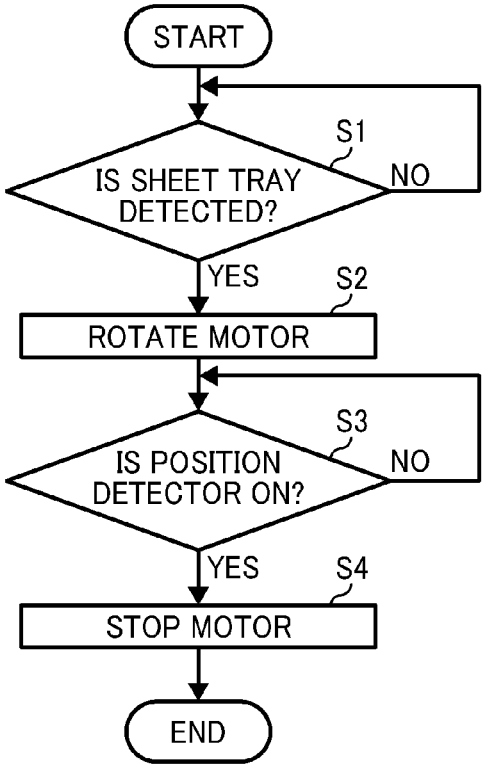
FIG. 10 is a flowchart illustrating steps starting from insertion of the sheet tray into the body to preparation for printing.

FIG. 10 is a flowchart of the operation of the drive unit 60 to lift the bottom plate 51 according to the present embodiment. FIG. 10 illustrates steps starting from insertion of the sheet tray into the body before preparation for printing.

Referring to FIG. 10, when the tray detector 56 detects the sheet tray 10 at S1, at S2 the motor 68 starts rotation in a normal direction. The normal rotation of the motor 68 is continued until the position detector 58 is turned on. When the position detector 58 is turned on at S3, the motor 68 is stopped at S4. Then, the image forming apparatus 1 is on standby, waiting for printing jobs.

Figure 11:
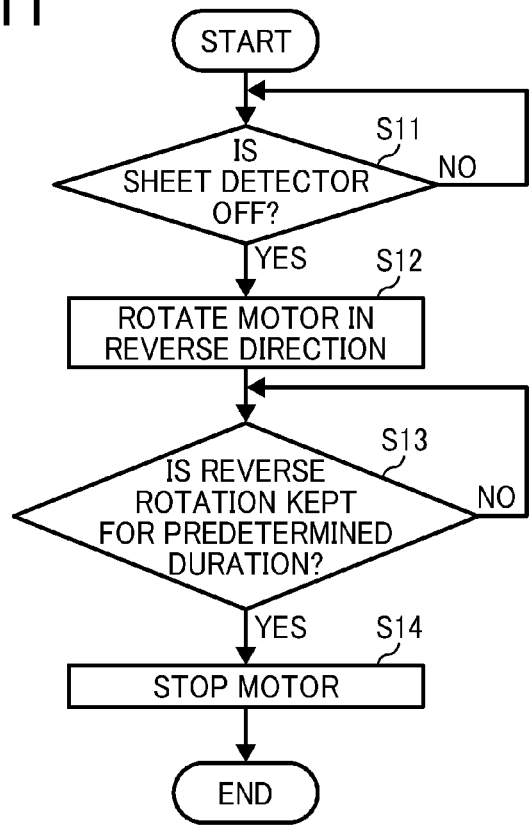
FIG. 11 is a flowchart illustrating steps performed after the sheet tray becomes empty.

FIG. 11 is another flowchart of the operation of the drive unit 60 to lift the bottom plate 51 according to the present embodiment. FIG. 11 illustrates steps after all sheets are fed from the sheet tray 10 being set in the body of the image forming apparatus 1 until the sheet tray 10 is ready for sheet loading.

In the above-described standby state for printing jobs, the connection between the coupling 65 and the pinion gear 64 receives a rotation load from the spring 62 of the lift unit 55, and a radial load is generated in the connection therebetween. Accordingly, a stronger force is required to draw out the sheet tray 10 in this state. In view of the foregoing, at S11 it is determined whether the sheet tray 10 is empty using the sheet detector 57. The sheet detector 57 is off when no sheet is present on the bottom plate 51. When the sheet detector 57 is off (Yes at S11), at S12 the motor 68 starts reverse rotation. At S13, it is determined whether the motor 68 has rotated in the reverse direction for a predetermined duration of time, which is three seconds in the present embodiment. After rotating in the reverse direction for the predetermined duration (Yes at S13), the motor 68 is stopped at S14. This operation can eliminate increases in the force for drawing out the sheet tray 10. In other words, when the sheet detector 57 detects that no sheet is present, the motor 68 is rotated in the reverse direction for a duration of time corresponding to the tooth number Z1 indicating the amount by which the rack 63 has moved the bottom plate pusher 61.

It is to be noted that a torque limiter is provided to the derive gear 70 of the drive unit 60 to transmit the drive force with a predetermined rotation torque. If the motor 68 does not stop rotating due to malfunction, the rack 63 strikes a wall of the sheet tray 10, causing idle running at the torque limiter. Thus, movement of the drive unit 60 can be stopped without damage to the components.

It is to be noted that the projection 67 of the pinion gear 64 can be constantly in phase with the recess 66 of the coupling 65 because the drive unit 60 does not rotate alone in the present embodiment. Even if the sheet tray 10 is drawn out with the bottom plate 51 being at the elevated position, the recess 66 of the coupling 65 is at the vertical position and can conform to the projection 67 of the pinion gear 64 being at the vertical position when the sheet tray 10 is inserted again. Thus, their phases can agree with each other in connection, and load or impediments to connecting are not generated.

In the sheet feeder according to the above-described embodiment, a pinion gear provided to the sheet feeder is connected to a rotation transmission device provided to an apparatus body using projection-and-recess engagement, and phases of the pinion gear and the rotation transmission device can confirm to each other constantly. Accordingly, load in insertion and drawing out of the sheet tray can be eliminated or reduced.

Numerous additional modifications and variations are possible in light of the above teachings. It is therefore to be understood that, within the scope of the appended claims, the disclosure of this patent specification may be practiced otherwise than as specifically described herein.

What is claimed is:

1. A sheet feeder mountable to a body of an apparatus to feed sheets thereto, the sheet feeder comprising:

a bottom plate on which the sheets are placed;

a bottom plate lift unit including:

a bottom plate pusher disposed beneath the bottom plate to push up the bottom plate, a rack member to rotate the bottom plate pusher vertically by moving horizontally, a pinion gear to cause the rack member to move horizontally, a biasing member attached between the bottom plate pusher and the rack member to pull the bottom plate pusher toward the rack member, and a position detector to detect positions of the rack member and the pinion gear, wherein the pinion gear is coupled via a coupling using projection-and-recess engagement to a rotation transmission device provided to the body to transmit a drive force for rotating the bottom plate pusher, and when Z1 represents a quantity of tooth of the pinion gear by which the rack member is moved by the rotation transmission device, Z2 represents a total tooth number of the pinion gear, S represents a coupling division number of the rotation transmission device coupled to the pinion gear, and N represents rotation number of the coupling, $Z1=Z2\cdot(1/S)\cdot N$ is satisfied.

2. The sheet feeder according to claim 1, further comprising:

a feed roller disposed above the sheets stacked on the bottom plate; and a separator to separate one from a rest of the sheets fed by the feed roller, wherein the bottom plate is housed in a sheet container, and the position detector is provided to the sheet container.

3. The sheet feeder according to claim 1, wherein the biasing member comprises a spring.

4. An image forming apparatus comprising:

an image forming unit to form images on sheets of recording media; and a sheet feeder mountable to a body of the image forming apparatus to feed the sheets to the body, the sheet feeder comprising:

a bottom plate on which the sheets are placed;

a bottom plate lift unit including:

a bottom plate pusher disposed beneath the bottom plate to push up the bottom plate, a rack member to rotate the bottom plate pusher vertically by moving horizontally, a pinion gear to cause the rack member to move horizontally, a biasing member attached between the bottom plate pusher and the rack member to pull the bottom plate pusher toward the rack member, and a position detector to detect positions of the rack member and the pinion gear, wherein the pinion gear is coupled via a coupling using projection-and-recess engagement to a rotation transmission device provided to the body to transmit a drive force for rotating the bottom plate pusher, and wherein $Z1=Z2\cdot(1/S)\cdot N$ is satisfied when Z1 represents a quantity of tooth of the pinion gear by which the rack member is moved by the rotation transmission device, Z2 represents a total tooth number of the pinion gear S represents a coupling division number of the rotation transmission device coupled to the pinion gear, and N represents rotation number of the coupling.

5. The image forming apparatus according to claim 4, further comprising:

a controller to causes the rotation transmission device to rotate the bottom plate pusher; and a sheet detector to detect whether any sheet is present on the bottom plate of the sheet feeder, wherein, when the sheet detector deems that no sheet is present on the bottom plate, the controller causes the rotation transmission device to rotate in a reverse direction for the quantity of tooth (Z1) of the pinion gear by which the rack member is moved.

6. The image forming apparatus according to claim 4, wherein a torque limiter is provided to the rotation transmission device.

* * * * *